US012313370B1

(12) United States Patent
Liu

(10) Patent No.: US 12,313,370 B1
(45) Date of Patent: May 27, 2025

(54) GAS CANISTER REPLACEMENT STRUCTURE OF TOY GUN

(71) Applicant: ACTION-ARMY COMPANY, New Taipei (TW)

(72) Inventor: Yung-Nung Liu, New Taipei (TW)

(73) Assignee: ACTION-ARMY COMPANY, New Taipei (TW)

( * ) Notice: Subject to any disclaimer, the term of this patent is extended or adjusted under 35 U.S.C. 154(b) by 17 days.

(21) Appl. No.: 18/518,620

(22) Filed: Nov. 24, 2023

(51) Int. Cl.
*F41B 11/62* (2013.01)
*F41B 11/89* (2013.01)

(52) U.S. Cl.
CPC ..... *F41B 11/62* (2013.01); *F41B 11/89* (2013.01)

(58) Field of Classification Search
CPC ..... F41B 11/62; F41B 11/68
USPC ..... 124/74
See application file for complete search history.

(56) References Cited

U.S. PATENT DOCUMENTS 4,774,929 A * 10/1988 Milliman ..... F41B 11/62 124/83
9,170,066 B2 * 10/2015 Cort ..... F41B 11/70
9,605,924 B1 * 3/2017 McCaslin ..... F41A 3/72

* cited by examiner

*Primary Examiner* — Reginald S Tillman, Jr.
(74) *Attorney, Agent, or Firm* — Leong C. Lei

(57) ABSTRACT

A gas canister replacement structure of a toy gun has a main structure including a push carrier, a carrier opening, a pressurized gas canister, a gas canister carrier, a carrier magnetic attraction portion, a magnetic element, and an elastic element. Based on such a structure, the gas canister carrier is fixed to the elastic element and the magnetic element only by means of the carrier magnetic attraction portion, so that it only needs to pull the push carrier through the barrel portion to expose the carrier opening in order to allow the gas canister carrier to be removed with a bare hand for replacement of the pressurized gas canister disposed therein, so as to achieve an effect of easy and efficient replacement of the pressurized gas canister.

9 Claims, 11 Drawing Sheets

GAS CANISTER REPLACEMENT STRUCTURE OF TOY GUN

BACKGROUND OF THE INVENTION

(a) Technical Field of the Invention

The present invention relates to replacement of pressurized gas canisters of large-sized toy guns, and more particularly to a gas canister replacement structure of a toy gun that features easy process, efficient operation, and simple structure.

(b) Description of the Prior Art

Pressurized gas is consumables of pneumatic toy guns. Operations are taken frequently for gas refilling or canister replacement. Refilling or replacement can be easily done with magazines for small-sized toy guns, but not for large-sized toy guns, such as rifles, submachine guns, sniper rifles, and hunting guns. Consequently, the large-sized toy guns suffer the following problems, which should be alleviated, for their operations:

(1) For gas refilling, although fast charging mechanisms can be available from the manufacturers, yet such mechanisms may result in undesired size expansion of the toy guns, and additional charging equipment may be needed, leading to obvious inconvenience for carrying.

(2) For gas refilling, replaceable or exchangeable canisters are obviously easy and convenient solutions, but, for large-sized guns, cartridges are often available with horizontally disposed magazines or cartridge chain, and for mimicking of large-sized toy guns, canisters cannot be replaced by means of exchange of magazines, and for any necessity of replacement of the canisters, the gun itself has to be disassembled in a tedious and sophisticated process.

(3) Further, disassembling of a gun involves steps of (a) separating the gun body and gun body cover, (b) pulling and withdrawing push carrier, (c) disassembling the push carrier, and (4) dismounting the gas canister to replace with a new one and followed by re-assembling and fastening, and the entire process of replacement is time-consuming and labor-consuming.

SUMMARY OF THE INVENTION

The primary objective of the present invention is to utilize an arrangement of a carrier magnetic attraction portion, a magnetic element, and an elastic element to simplify combination of a gas canister carrier with a push carrier to achieve easy removal for replacement and also to utilize an arrangement of the push carrier and a carrier opening to enable direct removal of the gas canister carrier without disassembling a toy gun.

To achieve the above objective, the present invention provides a toy gun that comprises a barrel portion, and a gas valve base is arranged in an interior of the barrel portion. A gas canister replacement structure mainly comprises: a push carrier, a carrier opening, a gas canister carrier, a pressurized gas canister, a carrier magnetic attraction portion, a magnetic element, and an elastic element, wherein the push carrier is movably disposed in the interior of the barrel portion and is in communication with the gas valve base; the carrier opening is formed in the push carrier; the gas canister carrier is arranged in an interior of the push carrier in a manner of being detachable through the carrier opening; the pressurized gas canister is received in the gas canister carrier; the carrier magnetic attraction portion is arranged at one end of the gas canister carrier; the magnetic element is movably disposed in the interior of the push carrier and is magnetically connected with the carrier magnetic attraction portion; the elastic element has one end fixed in the interior of the push carrier and an opposite end abutting and supported on one side of the magnetic element that is opposite to the gas canister carrier.

When a user uses the present invention to carry out disposition or replacement of the gas canister carrier, due to the gas canister carrier being fixed by means of the carrier magnetic attraction portion to the magnetic element and being secured as being urged by the elastic element, combination of the gas canister carrier with a toy gun is achieved with a simple arrangement. To remove out the pressurized gas canister, it only needs to pull the push carrier through the barrel portion to expose the carrier opening and the gas canister carrier can then be removed with a bare hand for replacement of the pressurized gas canister disposed therein, and as such, an effect of easy and efficient replacement of the pressurized gas canister is achieved.

Based on the above techniques, the problems of the known large-sized toy gun that gas refilling is inconvenient, canister replacement is tedious, and the toy gun has to be disassembled for the replacement can be overcome to thereby achieve practical improvements for realizing the above advantages.

DETAILED DESCRIPTION OF THE PREFERRED EMBODIMENTS

Figure 1:
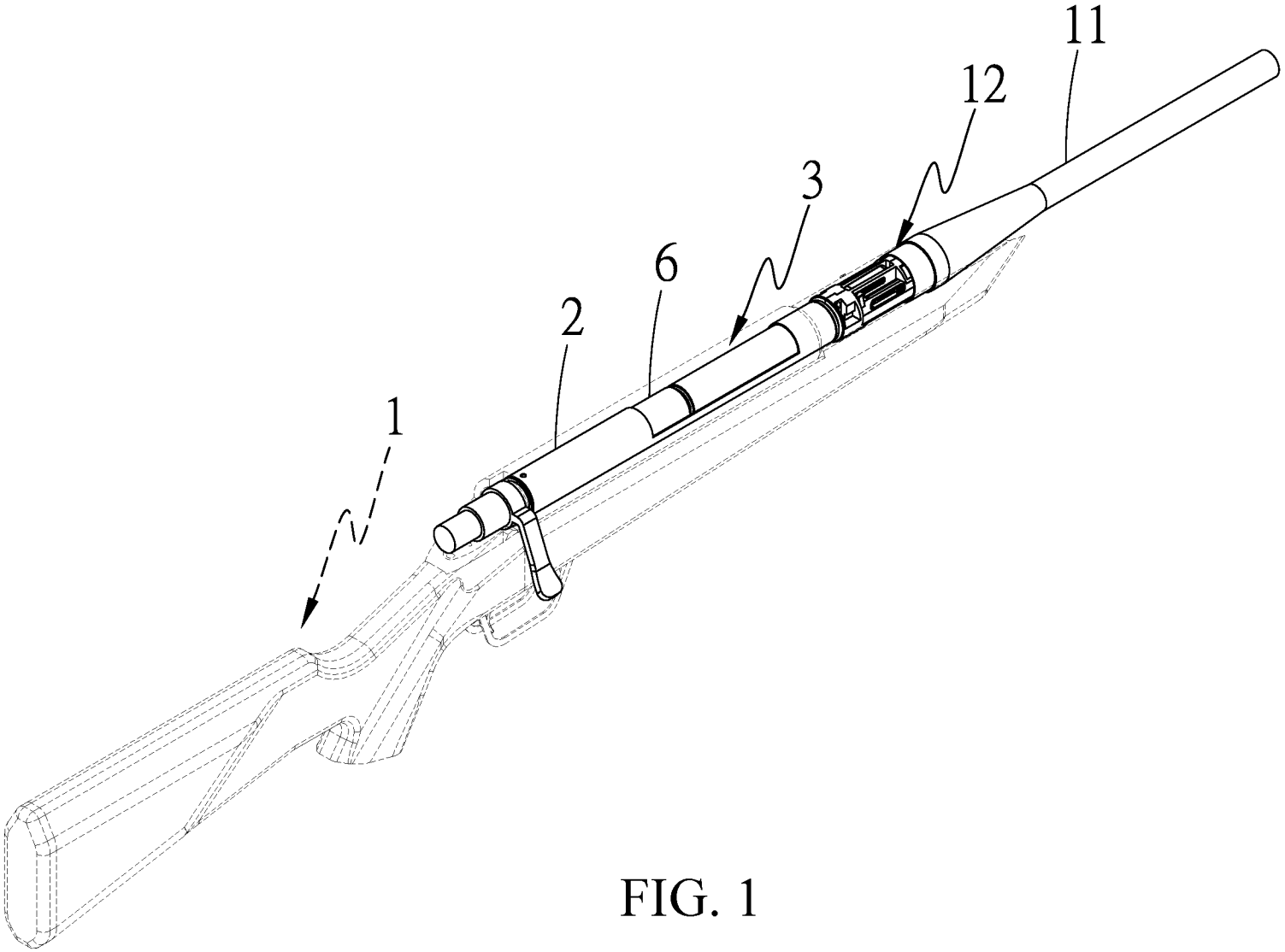
FIG. 1 is a perspective view showing a first preferred embodiment of the present invention.
Figure 2:
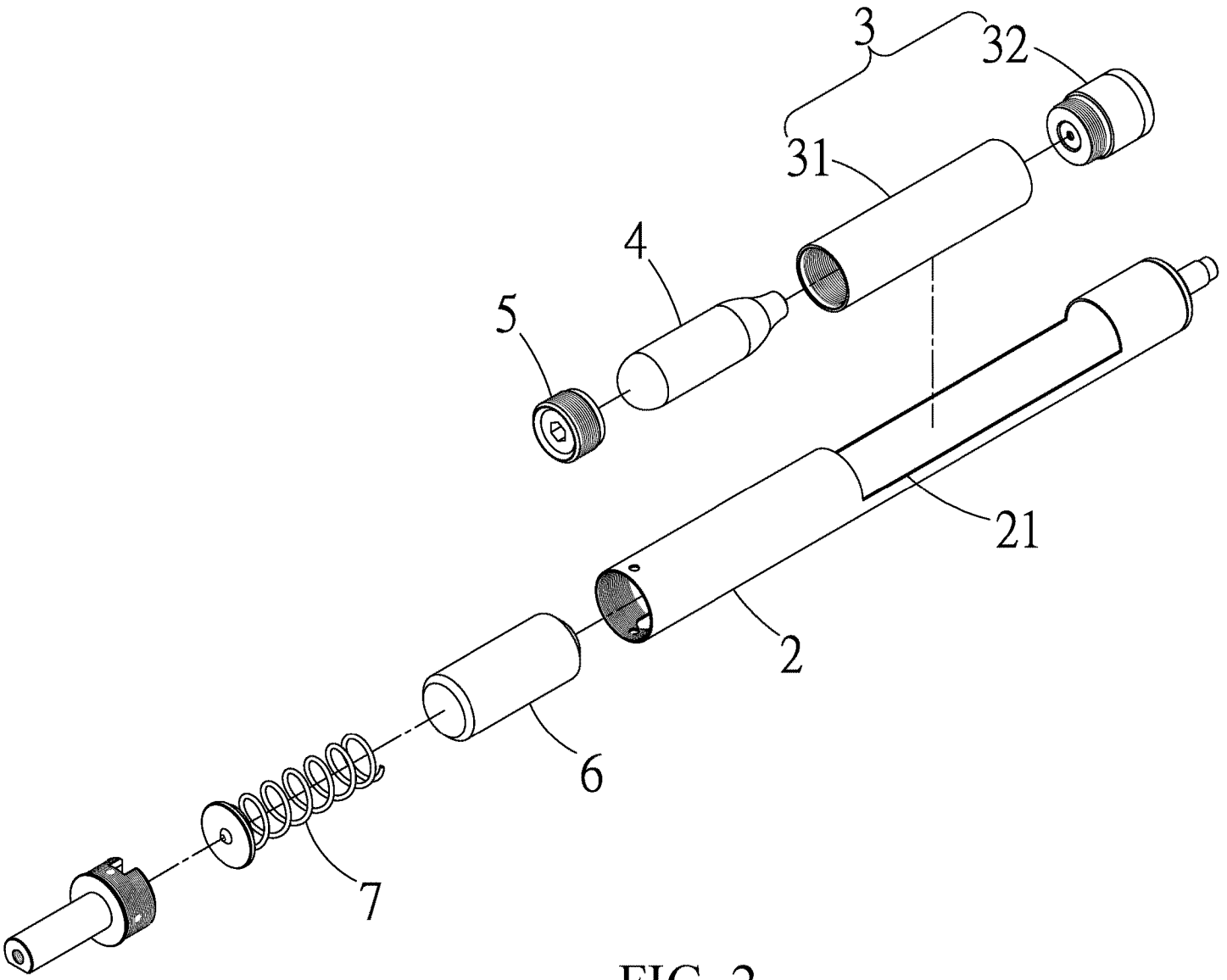
FIG. 2 is an exploded view showing the first preferred embodiment of the present invention, with a toy gun shown in a hidden form.
Figure 3:
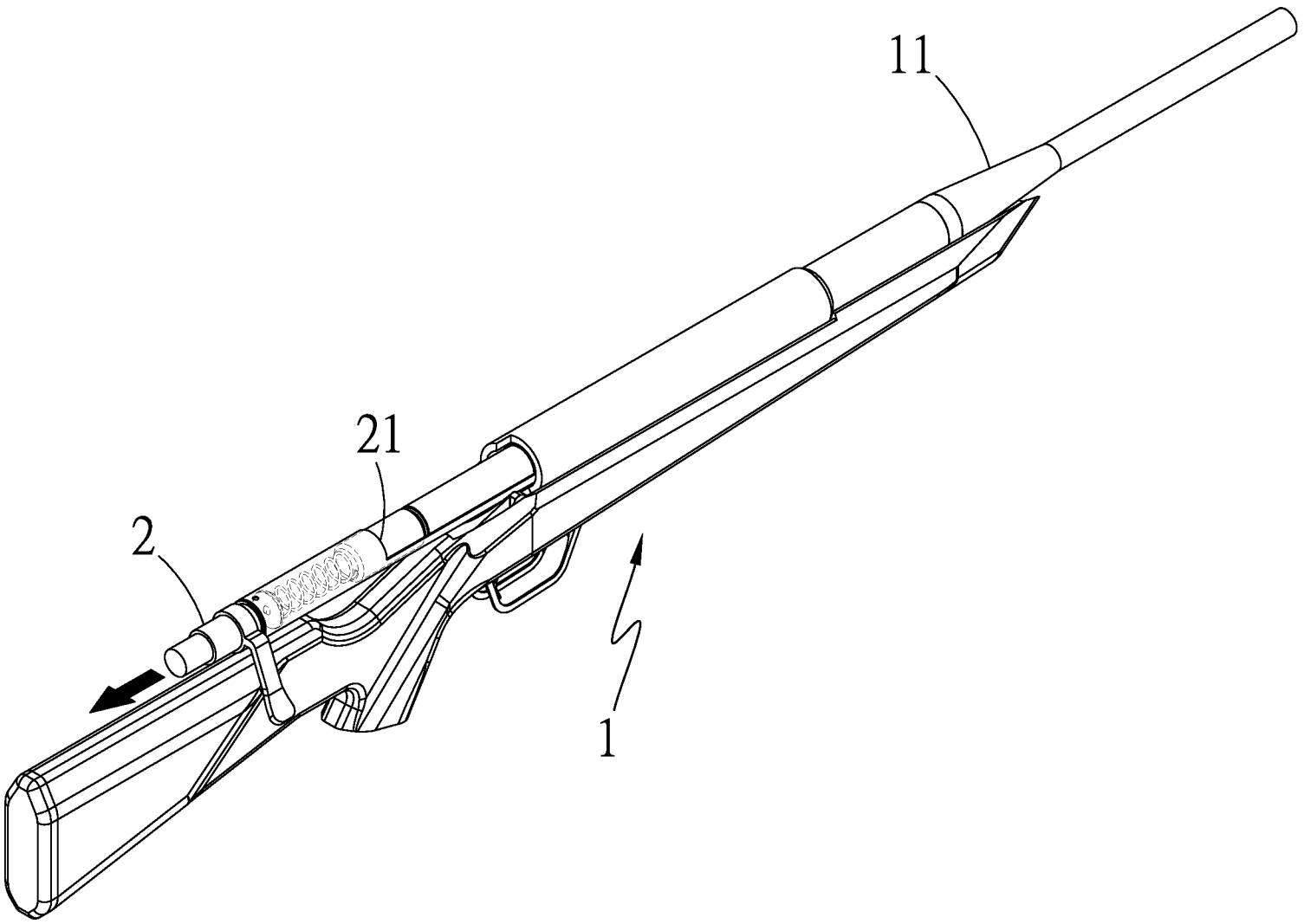
FIG. 3 is a schematic view showing removal of a gas canister according to the first preferred embodiment of the present invention.
Figure 4:
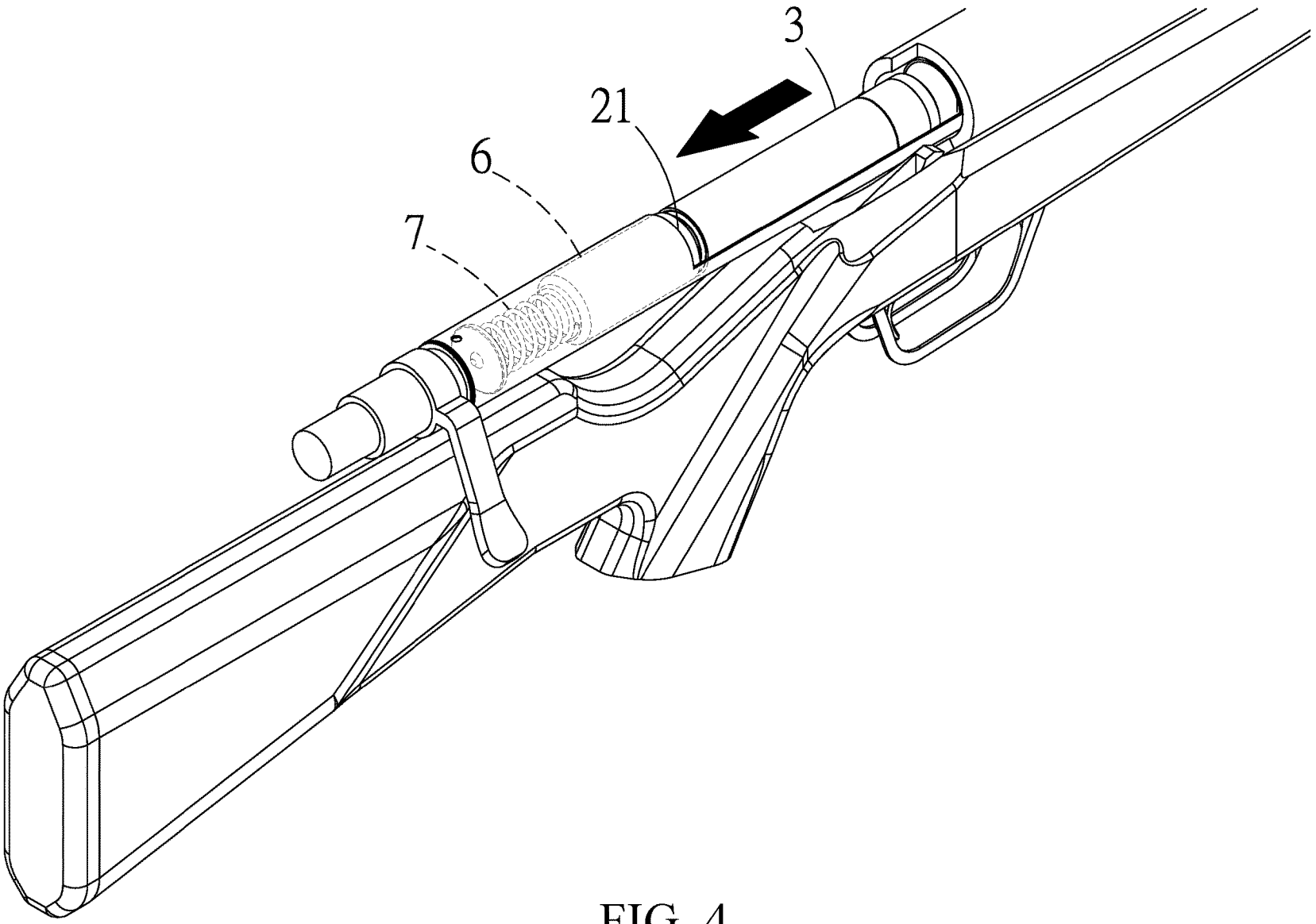
FIG. 4 is another schematic view showing removal of the gas canister according to the first preferred embodiment of the present invention.
Figure 5:
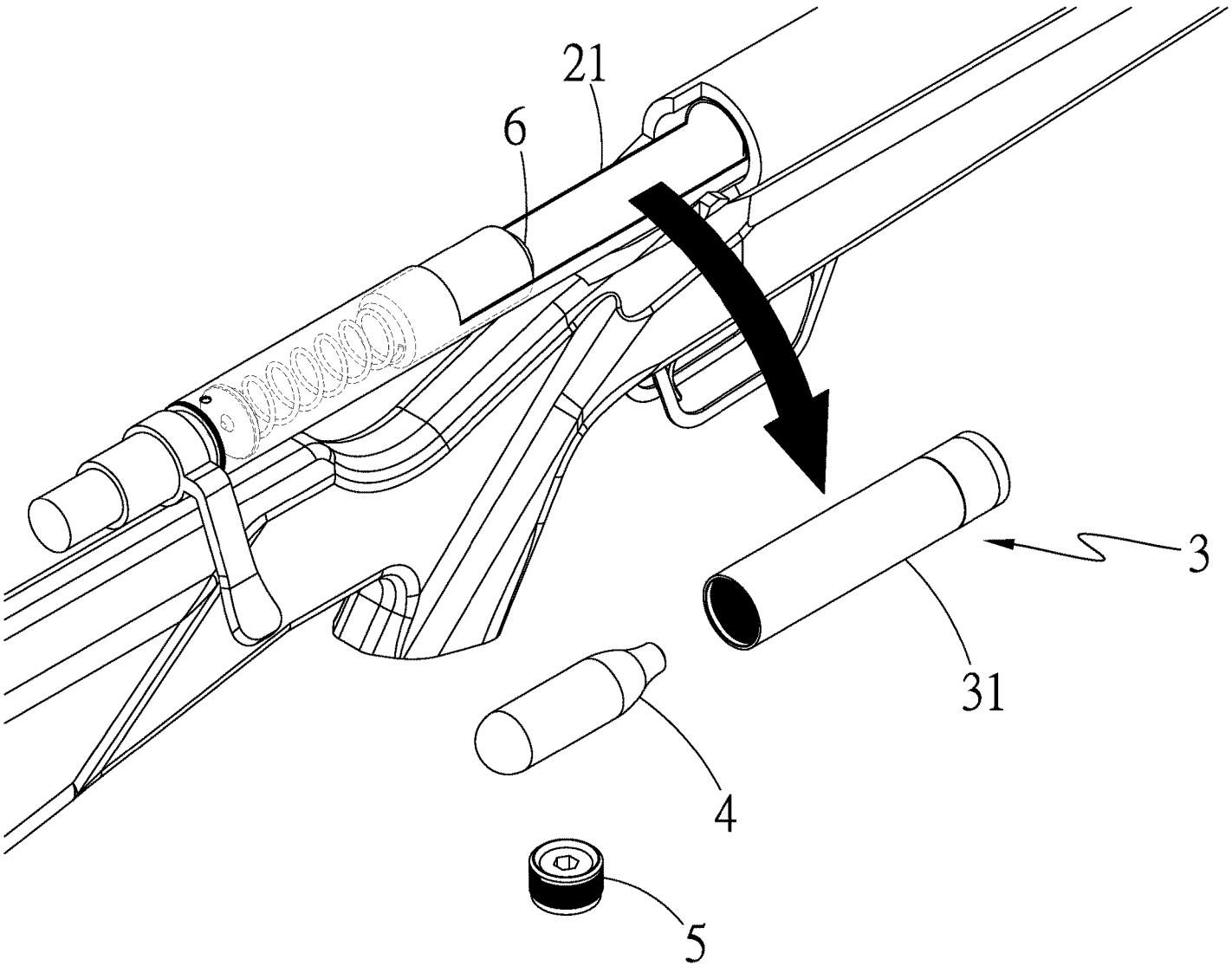
FIG. 5 is a further schematic view showing removal of the gas canister according to the first preferred embodiment of the present invention.

As shown in FIGS. 1-2, in the present invention a toy gun 1 comprises a barrel portion 11 and a gas valve base 12 arranged in an interior of the barrel portion 11, and a gas canister replacement structure mainly comprises:

a push carrier 2, which is movably arranged in the interior of the barrel portion 11 and in communication with the gas valve base 12;

a carrier opening 21, which is formed in the push carrier 2;

a gas canister carrier 3, which is arranged in an interior of the push carrier 2 and is detachable therefrom through the carrier opening 21 and receives a pressurized gas canister 4 therein, wherein the gas canister carrier 3 comprises a gas canister portion 31 and a gas outlet portion 32 arranged at a front end of the gas canister portion 31;

a carrier magnetic attraction portion 5, which is arranged at a rear end of the gas canister portion 31 of the gas canister carrier 3;

a magnetic element 6, which is movably arranged in the interior of the push carrier 2 and is magnetically connected to the carrier magnetic attraction portion 5; and an elastic element 7, the elastic element 7 having one end fixed in the interior of the push carrier 2 and an opposite end abutting and supported on one side of the magnetic element 6 that is opposite to the gas canister carrier 3.

A large-sized toy gun 1, such as a rifle, a submachine gun, a sniper rifle, and a hunting gun, is taken as an example for illustrating the toy gun 1. The gas valve base 12 functions to supply pressurized gas to components related to bullet shooting and to establish communication among the push carrier 2, the gas outlet portion 32 of the gas canister carrier 3, and the pressurized gas canister 4. In the instant embodiment, the carrier magnetic attraction portion 5 is a metal cap that is attractable by the magnetic element 6 to close the gas canister portion 31. The elastic element 7 is a compression spring. However, the above-listed configurations/structures of the components are provided as examples of the preferred embodiment and any other configurations/structures having similar functions are considered falling in the scope of the present invention, not just limited to the examples listed above.

As shown in FIGS. 1-5, the present invention provides an arrangement that utilizes magnetic attraction to hold and fix the gas canister carrier 3 in the interior of the push carrier 2, wherein the magnetic element 6 is disposed in the interior of the push carrier 2 to attract and retain the carrier magnetic attraction portion 5 at one end of the gas canister carrier 3 in position, and the elastic element 7 is arranged at one side of the magnetic element 6 that is opposite to the gas canister carrier 3 in order to utilize the spring force thereof to tightly support the magnetic element 6 to have the magnetic element 6 securely attached to and attracting the carrier magnetic attraction portion 5, and this, together with a wall of the push carrier 2, fixes the gas canister carrier 3 in the interior of the push carrier 2, whereby structural arrangement and combination of the gas canister carrier 3 and the push carrier 2 can be simplified, and the arrangement of the carrier opening 21 is utilized to ease removal thereof for replacement.

In an attempt to replace the pressurized gas canister 4, a user only needs to move, through pulling, the push carrier 2 by means of the barrel portion 11 to expose the carrier opening 21 outside of the toy gun 1, so that the gas canister carrier 3 can be pushed inward and the magnetic element 6 is caused to compress the elastic element 7 to allow the gas canister carrier 3 to move to the carrier opening 21, and the user is thus allowed to pick, with a bare hand, the gas canister carrier 3 through the carrier opening 21 thereby separating or detaching the gas canister carrier 3 from the magnetic element 6. Afterwards, the carrier magnetic attraction portion 5 is rotated to detach from the gas canister portion 31 to allow the pressurized gas canister 4 in the interior thereof to be easily replaced, and this achieves an effect of easy and efficient replacement of the pressurized gas canister 4.

Figure 6:
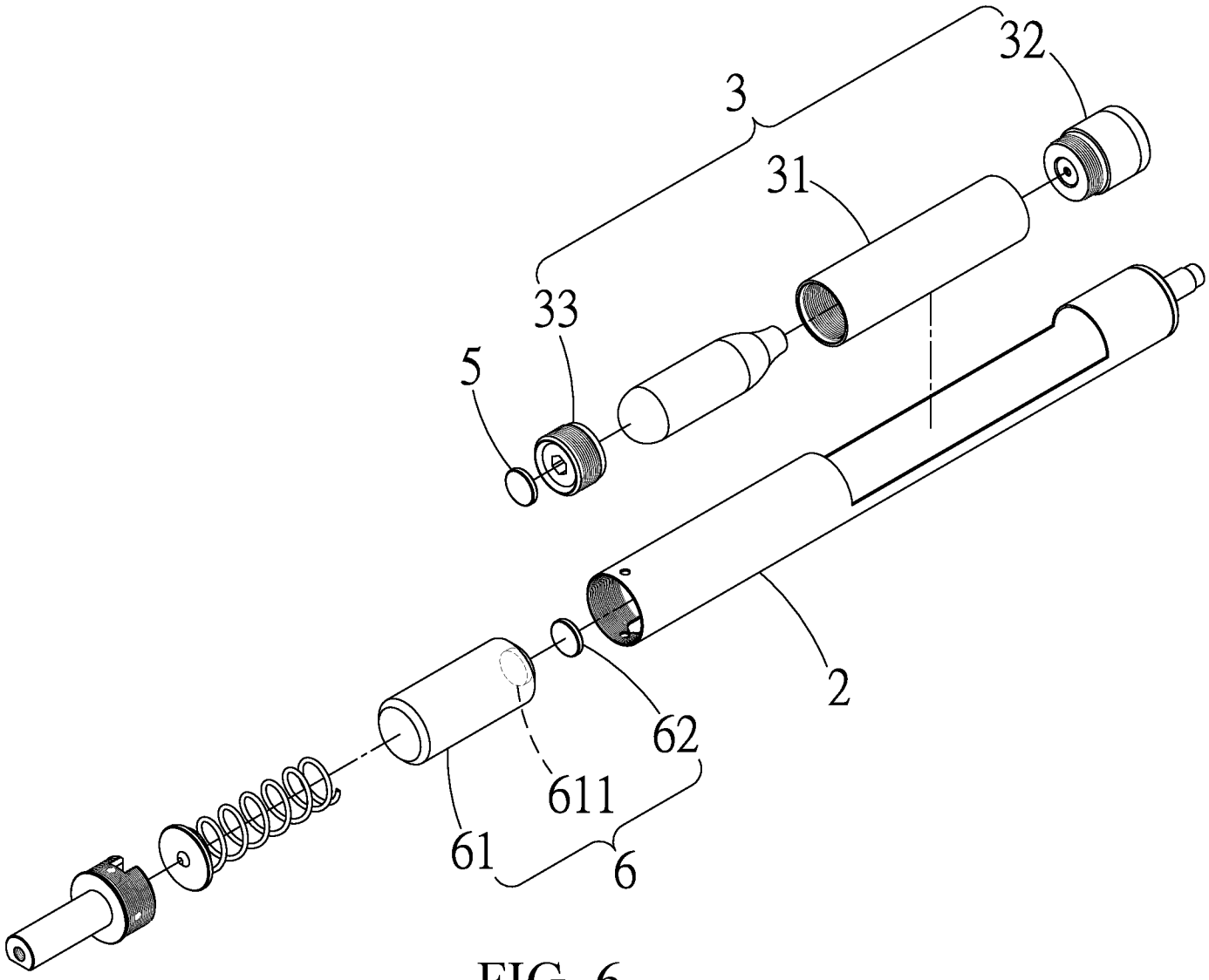
FIG. 6 is an exploded view showing a second preferred embodiment of the present invention.

As shown in FIG. 6, a difference of the instant embodiment is that the gas canister carrier 3 comprises a gas canister portion 31, a gas outlet portion 32 arranged at a front end of the gas canister portion 31, and a closure member 33 arranged, in a screwed manner, at a rear end of the gas canister portion 31, and the carrier magnetic attraction portion 5 is mounted outside of the closure member 33, and the magnetic element 6 comprises a main body portion 61, a magnetic attraction trough 611 formed in a front end of the main body portion 61, and a magnetic attraction portion 62 disposed in the magnetic attraction trough 611. Based on the above-described structure, a magnetic attraction structure between the gas canister carrier 3 and the magnetic element 6 is arranged in a configuration of being separable from the main body. For example, the carrier magnetic attraction portion 5 is removably attached, through force fitting, to an end wall of the closure member 33 and the magnetic attraction portion 62 is removably mounted, through force fitting, in the magnetic attraction trough 611, meaning the carrier magnetic attraction portion 5 is additionally mounted to the outside of the closure member 33 and the magnetic attraction portion 62 is additionally mounted in the magnetic attraction trough 611. As such, the gas canister portion 31 and the main body portion 61 can be selected as materials that are stronger or cheaper and possess no magnetism, so that flexibility of material selection is enhanced and easiness of combination between the gas canister carrier 3 and the push carrier 2 is maintained.

Figure 7:
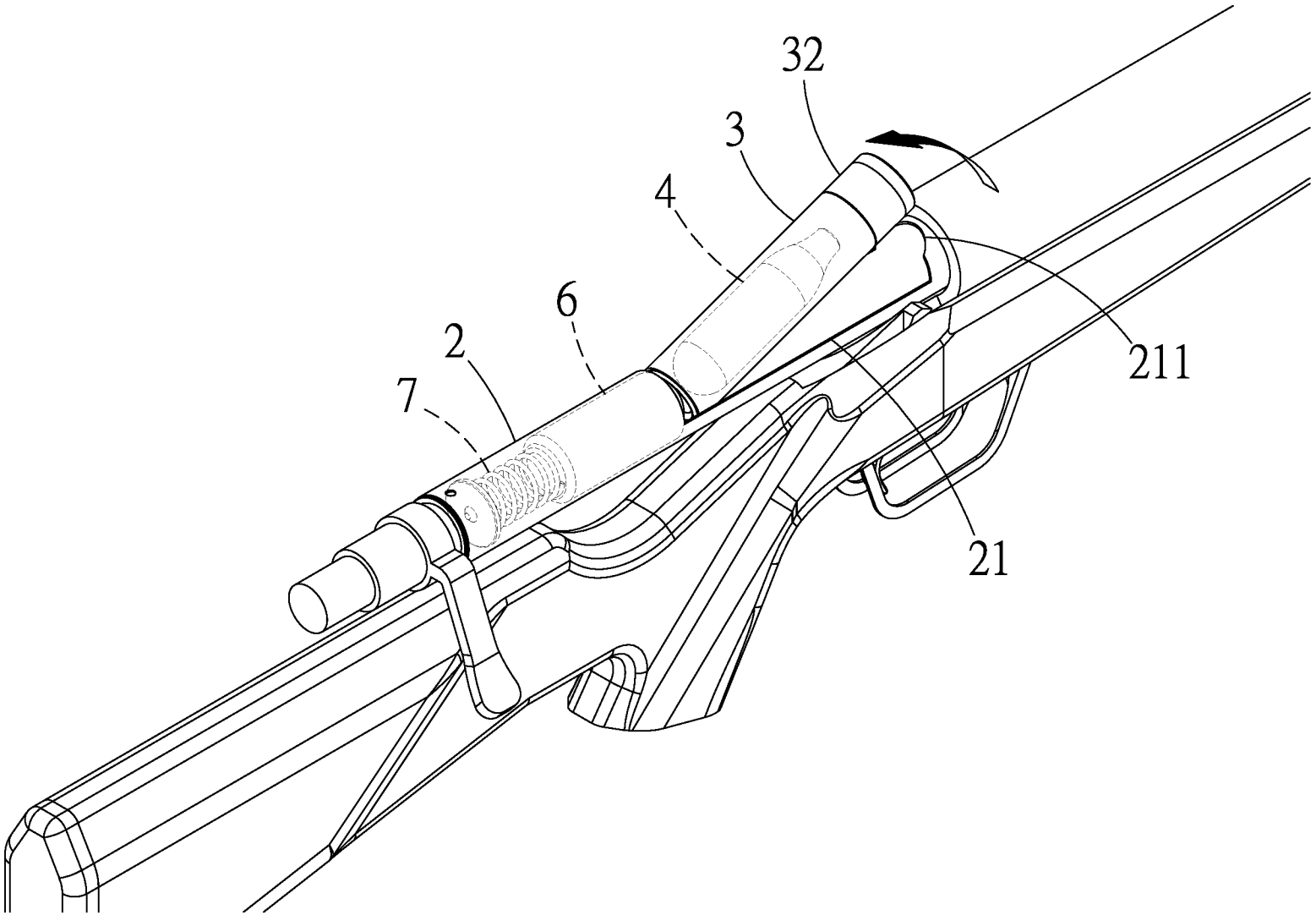
FIG. 7 is a schematic view showing implementation of a third preferred embodiment of the present invention.

As shown in FIG. 7, a difference of the instant embodiment is that the push carrier 2 comprises a removal assisting portion 211 arranged at one side of the carrier opening 21, and a length of the carrier opening 21 is less than a length of the gas canister carrier 3. In the instant embodiment, the removal assisting portion 211 is a curved notch formed in one side of the carrier opening 21 that is distant from the magnetic element 6. In an attempt to remove out the gas canister carrier 3, the user similarly moves the gas canister carrier 3 to compress the elastic element 7 to expose one end of the gas canister carrier 3 associated with the gas outlet portion 32 in the carrier opening 21, and the, a finger can be placed into the removal assisting portion 211 to pick up the gas canister carrier 3, and the operation of removal is easy and does not require the entirety of the gas canister carrier 3 be located in the range of the carrier opening 21, so as to be applicable to different sizes of the gas canister carrier 3 and the pressurized gas canister 4.

Figure 8:
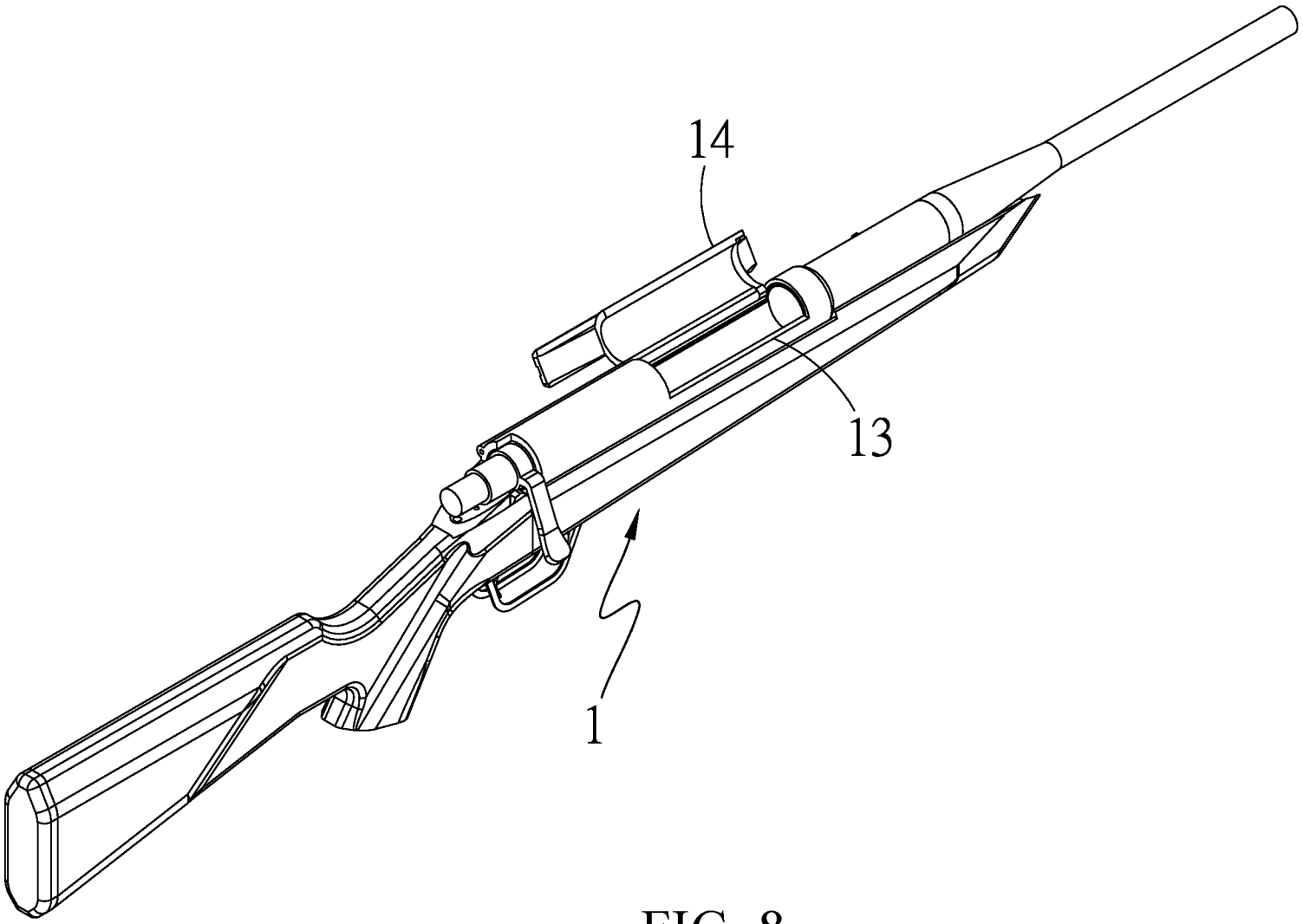
FIG. 8 is a schematic view showing a toy gun structure according to a fourth preferred embodiment of the present invention.
Figure 9:
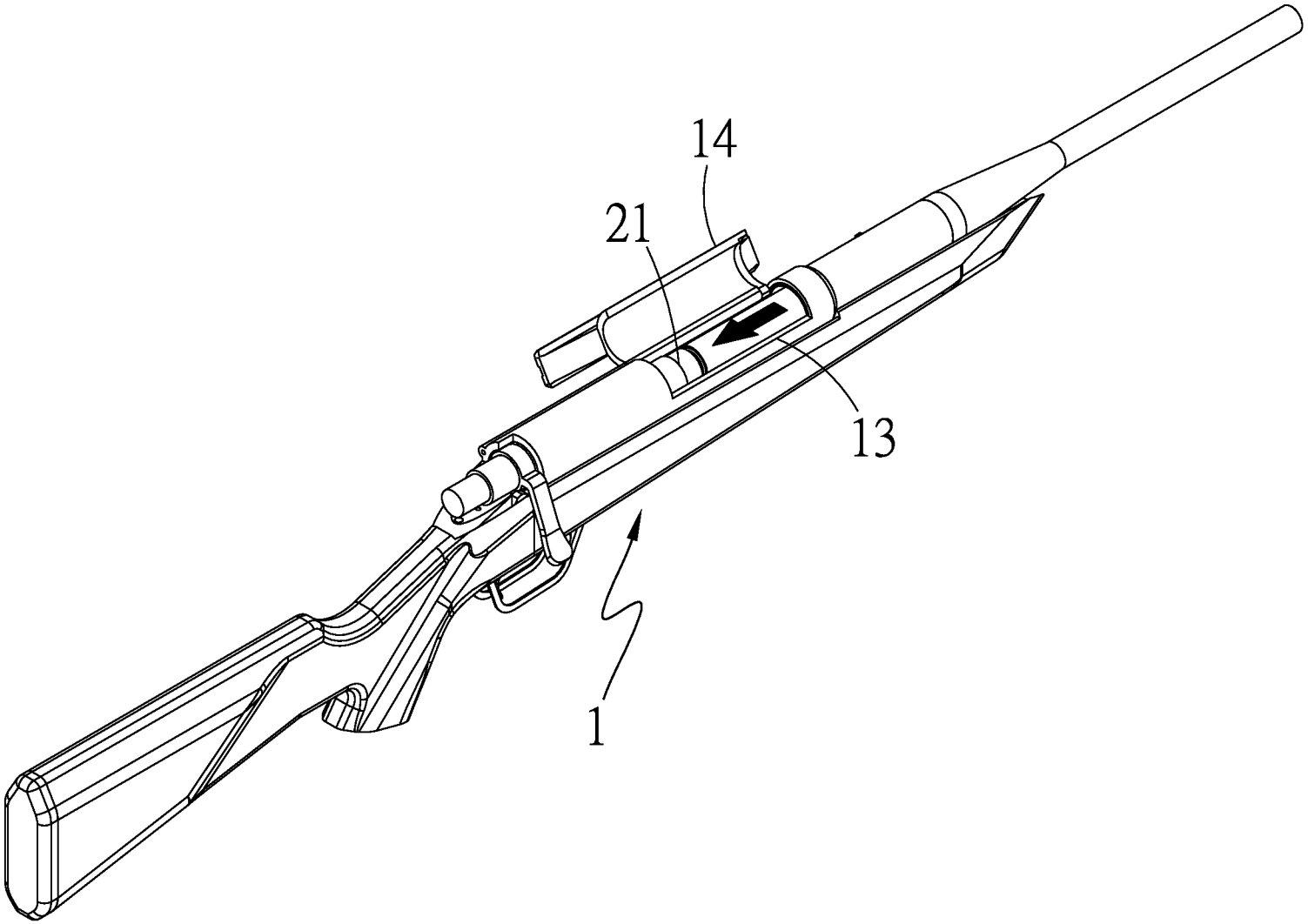
FIG. 9 is a schematic view showing operation of the fourth preferred embodiment of the present invention.
Figure 10:
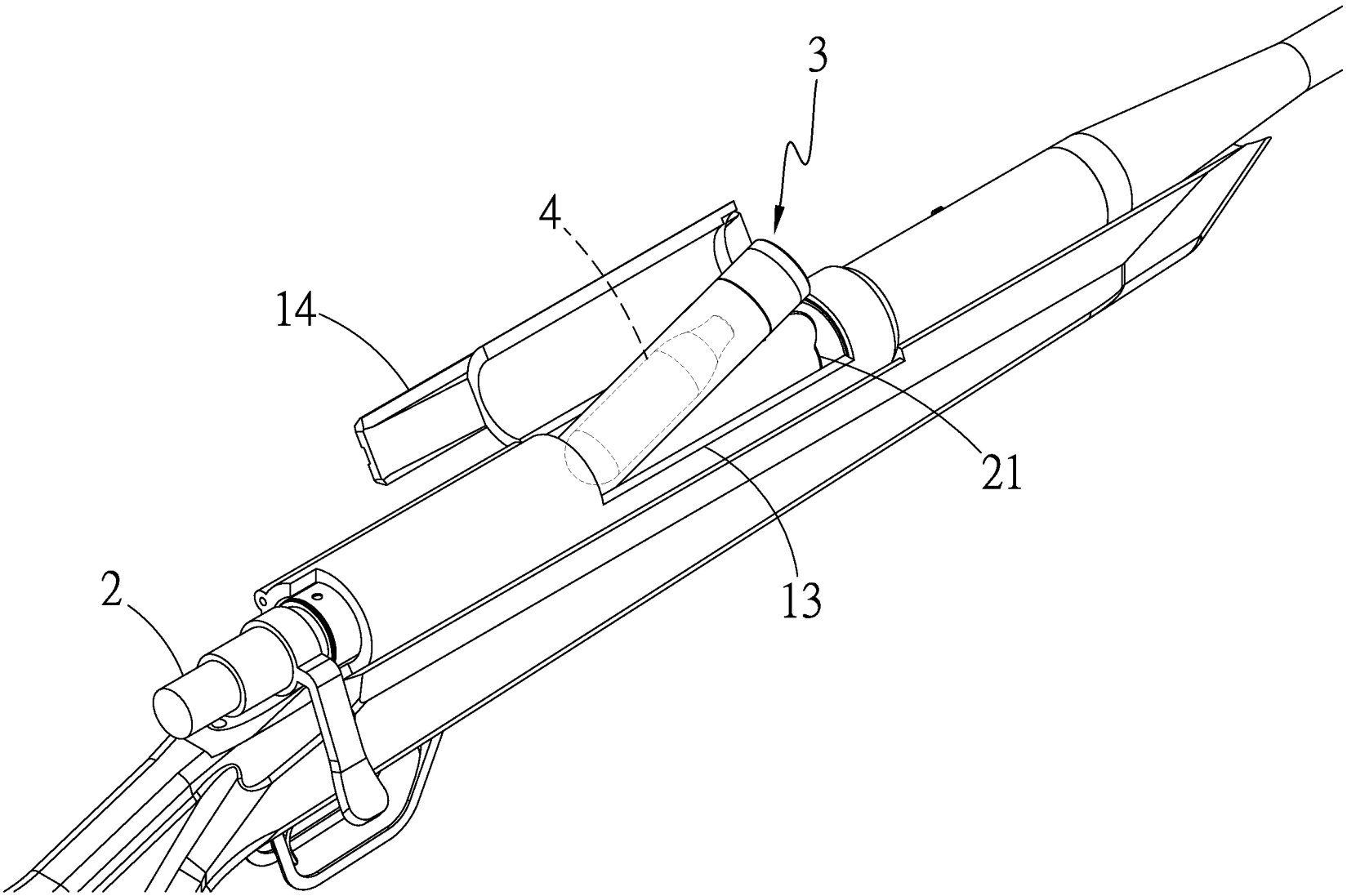
FIG. 10 is a schematic view showing removal of a gas canister according to the fourth preferred embodiment of the present invention.

As shown in FIGS. 8-10, a difference of the instant embodiment is that the toy gun 1 comprises a gun barrel cover 14 for closing and covering the carrier opening 21. In the instant embodiment, the gun barrel cover 14 is pivotally mounted to one side of the carrier opening 21. Based on difference of types of the toy gun 1, in case that the toy gun 1 is provided with an opening portion 13 for mimicking an ejection opening, the gun barrel cover 14 can be arranged at one side of the opening portion 13, such that the gun barrel cover 14 can normally function for dust protection, while in an attempt to replace the pressurized gas canister 4, the user can simply open the gun barrel cover 14 and makes the carrier opening 21 of the push carrier 2 corresponding, in position, to the opening portion 13 of the toy gun 1 (for certain kinds of toy gun 1, the opening portion 13 is normally set in alignment with the carrier opening 21 and, in such a case, there is no need to move the push carrier 2), to allow the gas canister carrier 3 to be easily withdrawn or removed through the carrier opening 21 and the opening portion 13, so that there is no need to withdraw the entirety of the gas canister carrier 3 or to reduce a movement range of the gas canister carrier 3, thereby further simplifying the operation of replacing the pressurized gas canister 4.

Figure 11:
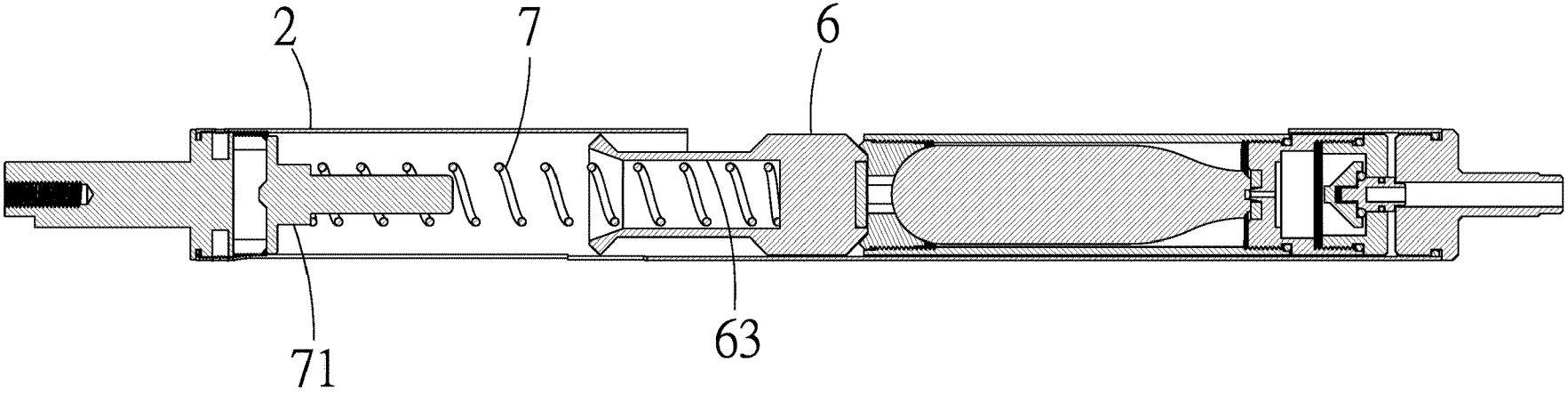
FIG. 11 is a schematic view showing an elastic structure of a fifth preferred embodiment of the present invention.

As shown in FIG. 11, which provides a cross-sectional view of the push carrier 2, the instant embodiment, which is similar to the previous embodiments, is different in that a positioning member 71 is arranged in the interior of the push carrier 2 to receive the elastic element 7 to fit thereon, and a receiving portion 63 is formed in the magnetic element 6 to receive the positioning member 71 and the elastic element 7 therein. The positioning member 71 is of an umbrella structure or a pillar structure to receive the elastic element 7 to fit thereon in order to prevent distortion during compression when a spring outside diameter is smaller than an inside diameter of the push carrier 2. The receiving portion 63 is in the form of a recess having an opening in a direction toward the positioning member 71, so that in constructing the magnetic element 6, it is feasible to simultaneously form the receiving portion 63 in the magnetic element 6 to receive the positioning member 71 and the elastic element 7. As such, an inner wall of the receiving portion 63 can be used to position and constrain the elastic element 7, and a lengthwise space required for the magnetic element 6 and the elastic element 7 (a lengthwise direction being defined as a moving direction of the push carrier 2) can be reduced.

I claim:

1. A gas canister replacement structure of a toy gun, the toy gun comprising a barrel portion, a gas valve base being arranged in an interior of the barrel portion, the gas canister replacement structure mainly comprising:

a push carrier, which is movably arranged in the interior of the barrel portion and in communication with the gas valve base;

a carrier opening, which is formed in the push carrier;

a gas canister carrier, which is arranged in an interior of the push carrier in a manner of being detachable through the carrier opening for receiving and holding a pressurized gas canister therein;

a carrier magnetic attraction portion, which is arranged at one end of the gas canister carrier;

a magnetic element, which is movably arranged in the interior of the push carrier and is magnetically connected to the carrier magnetic attraction portion; and an elastic element, the elastic element having one end fixed in the interior of the push carrier and an opposite end abutting one side of the magnetic element that is opposite to the gas canister carrier.

2. The gas canister replacement structure of the toy gun according to claim 1, wherein the toy gun is provided with a gun barrel cover for closing the carrier opening.

3. The gas canister replacement structure of the toy gun according to claim 1, wherein the push carrier is provided with a removal assisting portion arranged at one side of the carrier opening.

4. The gas canister replacement structure of the toy gun according to claim 1, wherein the push carrier comprises a positioning member arranged in the interior thereof for receiving the elastic element to fit thereon.

5. The gas canister replacement structure of the toy gun according to claim 4, wherein the magnetic element is provided with a receiving portion for receiving the positioning member and the elastic element.

6. The gas canister replacement structure of the toy gun according to claim 1, wherein the gas canister carrier comprises a gas canister portion and a gas outlet portion arranged at a front end of the gas canister portion, and the carrier magnetic attraction portion is mounted, in a screwed manner, at a rear end of the gas canister portion.

7. The gas canister replacement structure of the toy gun according to claim 1, wherein the gas canister carrier comprises a gas canister portion, a gas outlet portion arranged at a front end of the gas canister portion, and a closure member mounted, in a screwed manner, at a rear end of the gas canister portion, and the carrier magnetic attraction portion is disposed outside of the closure member.

8. The gas canister replacement structure of the toy gun according to claim 1, wherein the magnetic element comprises a main body portion, a magnetic attraction trough formed in a front end of the main body portion, and a magnetic attraction portion arranged in the magnetic attraction trough.

9. The gas canister replacement structure of the toy gun according to claim 1, wherein the carrier opening has a length that is less than a length of the gas canister carrier.

* * * * *